US005967638A

United States Patent [19]

Gorman, Jr. et al.

[11] Patent Number: 5,967,638

[45] Date of Patent: Oct. 19, 1999

[54] ILLUMINATED DIVING ROD

[76] Inventors: John W. Gorman, Jr.; Laurie Gorman, both of 7033 Greenbrier Dr., Seminole, Fla. 33777

[21] Appl. No.: 09/005,134

[22] Filed: Jan. 9, 1998

[51] Int. Cl.[6] ..... F21V 31/00

[52] U.S. Cl. ..... 362/84; 362/158; 362/577; 362/582; 362/109

[58] Field of Search ..... 362/32, 84, 102, 362/109, 119, 158, 267, 582, 577

[56] References Cited

U.S. PATENT DOCUMENTS

| | | | |
|---|---|---|---|
| 2,247,258 | 6/1941 | Shepard | 362/109 |
| 2,358,867 | 9/1944 | Madan | 362/109 |
| 2,539,071 | 1/1951 | Glenn | 362/109 |
| 2,561,122 | 7/1951 | Juergens | 362/109 |
| 3,924,115 | 12/1975 | Hampton et al. | 362/109 |
| 4,231,077 | 10/1980 | Joyce et al. | 362/109 |
| 4,429,350 | 1/1984 | Guthrie | 362/120 |
| 4,544,990 | 10/1985 | Wieselman et al. | 362/109 |
| 5,003,437 | 3/1991 | Barrett | 362/109 |
| 5,392,203 | 2/1995 | Harris, Jr. | 362/186 |
| 5,580,147 | 12/1996 | Salerno | 362/109 |
| 5,622,422 | 4/1997 | Rodgers | 362/158 |

*Primary Examiner*—Thomas M. Sember

[57] ABSTRACT

An illuminated diving rod for use in areas or conditions of zero or low visibility, comprising a transparent tubular rod member with an angled distal tip at one end, the tip being angled from the central longitudinal axis of the rod member from about 30° to about 45°. A handle assembly comprising a housing, a power source mounted in the housing, a switch strip mounted in the housing and moveable bulb and reflector seat moveably mounted in the housing is secured to the opposite end of the rod member. A cover member is threadably mounted to the housing and encases and engages the bulb and reflector seat. The rod member is mounted to and secured on the cover member at its proximal end, the rod member being constructed of a high impact strength clear plastic of high light transmissivity with a central positioned light transmitting material disposed substantially along its entire length, the transparent rod member upon activation of the power source and during zero or low visibility projecting a diffused beam of light toward objects which require illumination for sighting and engagement with the angled tip.

13 Claims, 1 Drawing Sheet

ILLUMINATED DIVING ROD

FIELD OF THE INVENTION

The present invention relates generally to an underwater diving rod and more particularity to an illuminated plastic rod with an angled front end and handle on the rear end.

BRIEF DESCRIPTION OF THE PRIOR ART

It is a common practice for many-divers to harvest lobsters by hand by reaching in coral caves or hidden areas to pull out lobsters. This practice assumes that only a lobster resides in the cave or hole and that no damage will be done to the hands by corral or other creatures living in the cave. Currently straight rods are used to attempt to prod the lobster into the open so that it can be captured. The rod is used to engage or "tickle" the lobster to bring the creature out of the cave which is a place of low illumination. Thus, there is a need to see if there is a lobster in the cave or if the same is inhabited by other creatures in addition to a need to provide direct illumination upon the lobster and area where the rod tip is placed.

There are a number of devices which have been used for specific illumination purposes. U.S. Pat. No. 5,003,437 to Barrett of Mar. 26, 1991, discloses an illuminated boat hook structure for boat docking and launching operations, at night or other times of low visibility. The structure of this invention comprises a tubular telescoping shaft member with a battery power source housed therein, a parabolic reflector and bulb, and associated wiring harness. A manual switch is mounted on the shaft member to energize the bulb. The forward end of the tubular shaft member holds an essentially transparent plastic hook shaped member which projects an unidirectional diffused beam of light generated from the bulb and light reflected from the parabolic reflector toward a dock or other objects which are to be sighted and engaged during zero or low visibility.

U.S. Pat. No. 4,429,350 to Guthrie issued Jan. 31, 1984 discloses an underwater illumination light with an encased bulb mounted on a foam flotation slab and a telescoping rod assembly. Current to power the bulb is provided by an external power source allowing a fisherman to illuminate flounders laying flat on the sandy bottom in shallow water so that the same may be gigged.

U.S. Pat. No. 3,510,643 to File issued May 5, 1970, shows a plastic eating utensil with an illuminated head (spoon, fork), the utensil handle holding the batteries and light bulb.

U.S. Pat. No. 2,479,157 to Fritts issued Aug. 16, 1949, is directed toward an illuminated tubular shaped ten yard marker for sports events.

U.S. Pat. No. 2,561,122 to Juergens issued Jul. 17, 1951 is directed toward a livestock prod with a battery powered lighted end having a cylindrical handle with a carrying loop secured thereto; and U.S. Pat. No. 2,358,867 to Madan issued Sep. 26, 1944 shows (FIG. 6) a translucent lighted hook which is attached to a walking stick which holds batteries and a connected light bulb.

U.S. Pat. No. 5,226,718 electrically to Lin issued Jul. 13, 1993 discloses a mountaineering stick with a battery powered light which is used to illuminate the shaft of the stock.

U.S. Pat. No. 1,051,370 to Hertz issued Jan. 21, 1913 is directed toward a walking cane with a lighted handle extending perpendicular to the cane axis. See also U.S. Pat. No. 1,509,157 to Leano issued Sep. 23, 1924 for a similar illuminated cane and U.S. Pat. No. 2,642,519 to Caustin et al., issued Jun. 16, 1953.

These prior art light illumination sources are not adapted to the particular needs of a diver. For this purpose it is desirable to provide a light source that can be easily handled underwater allowing illumination to be directed at a particular spot a number of feet distant from the diver while allowing the diver to probe the area of interest with the tip of the rod and if necessary move creatures such as lobsters with the angled tip of the rod.

SUMMARY OF THE INVENTION

The present invention provides an underwater lighting apparatus comprising a cylindrical rod with an angled tip and an enclosed handle secured to the rod containing a battery reflector and bulb for directing light through the rod to its tip. It thus provides an underwater lighting apparatus with an elongated handle allowing light to to be directed to an area in approximation with the end of the device.

It is an object of the present invention to provide a diving rod which can be easily illuminated and rapidly dissembled and reassembled.

Another object of the invention is to provide an improved diving rod which is light in weight and yet sufficiently strong to withstand the impact and shock when used in diving.

And yet another objective of the present invention is to provide the user with a diving probe which is reliable and yet very simple in construction and so it can be manufactured easily and inexpensively.

In the accompanying drawings, there is shown an illustrative embodiment of the invention from which these and other objectives, novel features, and advantages will be readily apparent.

DETAILED DESCRIPTION OF THE PREFERRED EMBODIMENT

Figures 1, 2, 3, 4, 5:
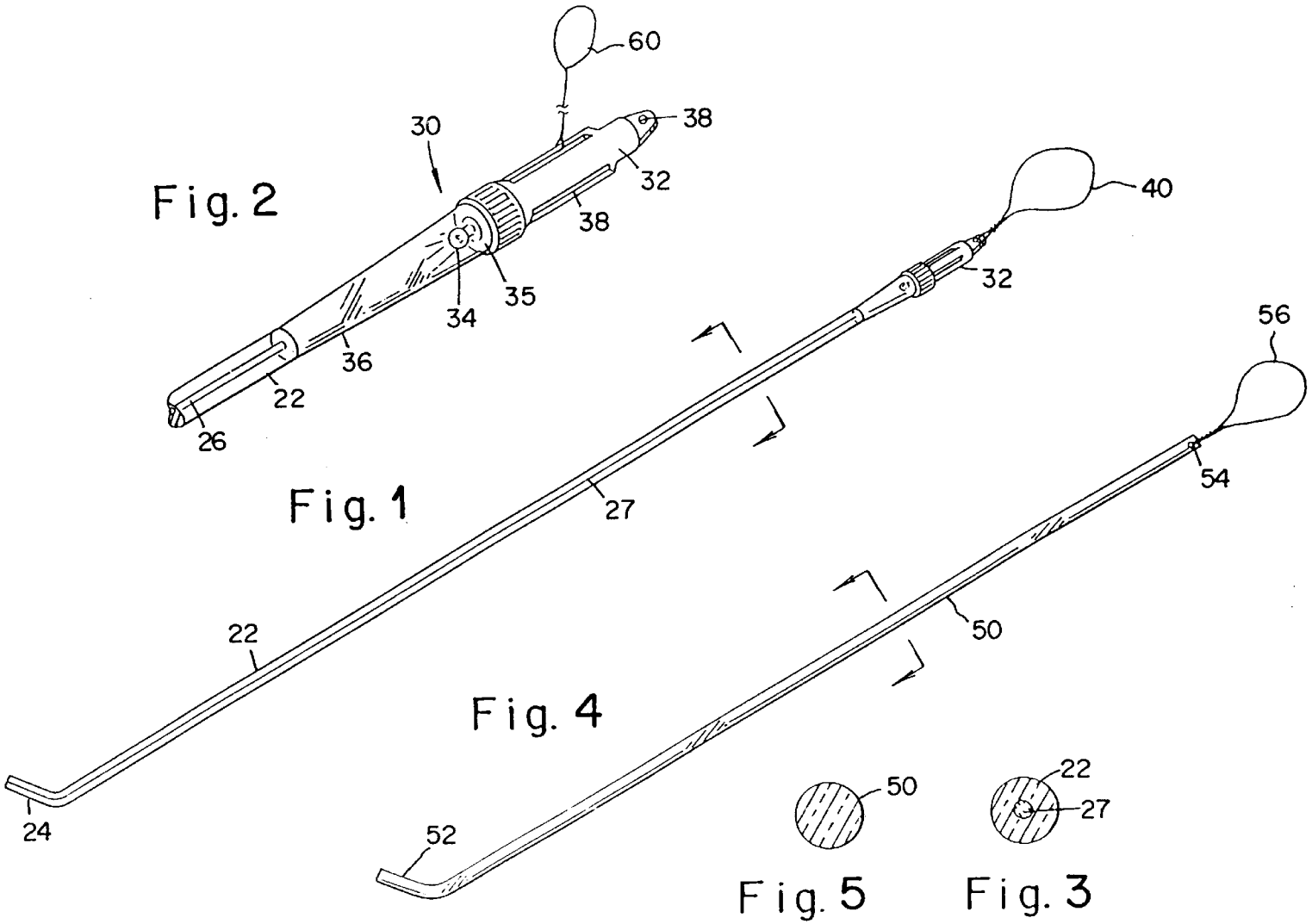
FIG. 1 is a perspective view of the diving rod invention.
FIG. 2 is an enlarged perspective view of the handle and light assembly of the diving rod shown in FIG. 1.
FIG. 3 is an enlarged cross sectional view of the rod of FIG. 1 taken along line 3'—3'.
FIG. 4 is perspective view showing an alternative embodiment of the diving rod.
FIG. 5 is an enlarged cross sectional view of the diving rod of FIG. 4 taken along line 5'—5'.

The preferred embodiment and best mode of the illuminated diving probe rod 20, is shown in FIGS. 1–3 of the accompanying drawings. An alternative embodiment of the height adjustable point retention bar assembly is shown in FIGS. 4 and 5. The diving probe assembly 20 is constructed of a cylindrical plastic rod 22 ranging from two to four feet in length and having a diameter from ½ to ¾ inches with an angled tip 24 of two to four inches in length on the distal end. The tip is angled in a range from 15° to 90° from a line drawn through the axis of the center of the rod with the preferred angle being from about 30° to about 45°. The rod and tip can be fabricated from one of a known number of polycarbonates such as LEXAN(®manufactured by General Electric Company or a polymethyl methacrylate such as "LUCITE" or POLYSTYRENE. If desired the plastic rod can be coated or contain luminous or phosphorescent materials that may consist of any phosphorescent compounds or luminous compound which upon excitation by light give off a dull glow of light for a protracted period. It is envisioned that the plastic matrix material of the rod can contain a luminescent material, which may be a phosphor material, fluorescent dye or any other material which is activated to produce light. The proximal end of rod 22 is secured to a handle and light assembly 30. The handle and light assembly has a housing 32 holding a flashlight battery or batteries (not shown) which are electrically connected to a bulb 34 mounted in a reflective seat 35 mounted in the housing 32. The housing provides selective electrical connection with a light bulb 34 by biasing the reflective seat 35 against an electrically conductive strip assembly (not shown) mounted in the housing. The light bulb 34 is covered by a threaded tapered truncated conical cap 36 which is secured to exterior threading on the housing 34 on its distal end, the cap 36 being secured to the proximal end of rod 22. When the cap 36 is threaded onto the housing, an interior shoulder engages the reflective seat driving the reflective seat and associated bulb downward into the housing and against the conductive strip assembly. The flat negative end of the battery or batteries engages a conductive spring strip or switch mounted in the housing and engaging the battery. As the reflective seat 35 is driven downward by the screwing action of the truncated conical cap, the reflective seat engages one end of the conductive spring switch completing the circuit and energizing the bulb 34. An "O" ring positioned at the base of the housing threaded portion forms a water tight seal so that the handle and light housing is waterproof When the cap 36 is unscrewed from the housing the circuit connection is broken and the light is turned off. The rod 22 can be provided with a light channel 26 in the nature of fiber optic material 27 to deliver the light to tip 24 allowing illumination several feet from the diver. The handle housing 32 provided with elongated slots 38 which can hold a wrist loop (not shown) for attachment to the diver and the end of the handle housing has an aperture 38 which holds a wrist loop 40. A float member 60 can be secured to the wrist loop or anchored to slot 38 allowing the rod to be easily recovered or spotted in the event that the rod is dropped while the diver is in the water or during entry from a boat into the water.

The tapered cap 36 can be constructed of transparent plastic to allow wide area illumination near the hand or can be constructed of opaque or light resistant material so that primary illumination occurs at the end of rod tip 24.

In the alternate embodiment shown in FIGS. 4 and 5, a rod 50 constructed of a solid light generating or luminescent plastic is used causing the entire rod to glow or luminesce. As an example, which is not construed as limiting to the invention, a phosphorescent type of material produced and sold by Hanovia Division of Conrad Inc. under the trademark "SPOT-LITE" can be used as can any luminescent material which absorbs energy from any light source to which it is exposed, whether natural sunlight, or artificial incadescent or fluorescent light, and chemically generate a luminous light in response thereto. Such material can produce an intense bright glow which is visible in absolute darkness for a period of up to an hour or even longer, after which time it continues to exhibit a visible glow for up to an additional eight hour period of time. After exposure of a short period of time to ambient light the luminescent material can be recharged to maximum capacity. The tip 52 is of the same angle as the embodiment shown in FIGS. 1–3 and the handle consists of a throughgoing bore 54 through which a flexible cord loop 56 is inserted and secured by means well known in the art.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

I claim:

1. An illuminated rod for use under water comprising a cylindrical rod member ranging from about 2 feet to about 4 feet in length with an distal tip portion angled 30° to 45° from the longitudinal center axis of the cylindrical rod member ranging from 2 inches to 5 inches at a distal end and a flexible loop mounted on its proximal end, said rod member including illumination means comprising a luminescent plastic.

2. An illuminated diving rod for use under water in areas or conditions of zero or low visibility, comprising a tubular rod member with an angled distal tip at one end, said rod member further including a light transmitting material formed in a cylindrical cross section with said tubular rod member concentrically surrounding said light transmitting material, a waterproof handle assembly secured to the opposite end thereof, said handle assembly comprising a housing, a power source mounted in said housing, switch means mounted on said housing section and bulb means selectively electrically connected to said power source, a cover member is mounted to said housing and encases said bulb means, said tubular rod member being constructed of a high impact strength clear plastic of high light transmissivity along substantially said rod member entire length, said transparent rod member upon activation of said power source and during zero or low visibility projecting a diffused beam of light toward objects which require illumination for sighting and engagement with said angled tip.

3. An illuminated diving rod as claimed in claim 2 wherein said cover member is a truncated cone.

4. An illuminated diving rod as claimed in claim 3 wherein said truncated cone has a distal end surface recessed to hold the proximal end of said rod member.

5. An illuminated diving rod as claimed in claim 3 wherein said truncated cone has a distal surface which is threaded to receive a threaded end of said rod member.

6. An illuminated diving rod as claimed in claim 2 wherein said distal rod tip section is angled from the center axis of the rod member in a range from about 10° to about 90°.

7. An illuminated diving rod as claimed in claim 2 wherein said light transmitting material is fiber optics.

8. An illuminated diving rod as claimed in claim 2 wherein said cover member includes a reflecting mirror positioned around said light bulb.

9. An illuminated diving rod as claimed in claim 2 wherein said cover member is made of an opaque material.

10. An illuminated diving rod as claimed in claim 2 including loop means mounted to said handle.

11. An illuminated diving rod for use under water in areas or conditions of zero or low visibility, comprising a transparent plastic tubular rod member with an angled distal tip at one end, said tip being angled from the central longitudinal axis of said rod member from about 30° to about 45° and extending outward from about 2 to about 5 inches, a handle assembly secured to the opposite end of said tubular plastic rod member, said handle assembly comprising a housing, a power source mounted in said housing, switch means mounted on said housing section and moveable bulb means connected to said power source, a cover member threadably mounted to said housing and encasing and engaging said bulb means, said transparent rod member mounted to said cover member at its proximal end, said tubular rod member being constructed of a high impact strength clear plastic of high light transmissivity with a centrally positioned fiber optic light transmitting material disposed substantially along its entire length, said transparent rod member upon activation of said power source and during zero or low visibility projecting a diffused beam of light toward objects which require illumination for sighting and engagement with said angled tip.

12. An illuminated diving rod for use in areas or conditions of zero or low visibility as claimed in claim 11 wherein said handle housing has loop means mounted thereto.

13. An illuminated diving rod for use in areas or conditions of zero or low visibility as claimed in claim 11 wherein said handle housing includes a float member connected thereto.

* * * * *